US010088237B2

(12) United States Patent
Bilgen et al.

(10) Patent No.: US 10,088,237 B2
(45) Date of Patent: Oct. 2, 2018

(54) UNCOOLED FURNACE ROLL AND METHOD FOR PRODUCING AN UNCOOLED FURNACE ROLL

(71) Applicants: SMS Group GmbH, Duesseldorf (DE); Schmidt+Clemens GmbH & Co., KG, Lindlar (DE)

(72) Inventors: Christian Bilgen, Duesseldorf (DE); Alexander Meyer, Duesseldorf (DE); Wolfgang Schroemges, Overath (DE); Stefan Mohr, Gummersbach (DE)

(73) Assignees: SMS GROUP GMBH, Duesseldorf (DE); SCHMIDT+CLEMENS GMBH + CO. KG, Lindlar (DE)

( * ) Notice: Subject to any disclaimer, the term of this patent is extended or adjusted under 35 U.S.C. 154(b) by 0 days.

(21) Appl. No.: 15/529,544

(22) PCT Filed: Oct. 28, 2015

(86) PCT No.: PCT/EP2015/074928
§ 371 (c)(1),
(2) Date: May 25, 2017

(87) PCT Pub. No.: WO2016/083055
PCT Pub. Date: Jun. 2, 2016

(65) Prior Publication Data

US 2017/0307295 A1 Oct. 26, 2017

(30) Foreign Application Priority Data

Nov. 28, 2014 (DE) ..... 10 2014 224 445

(51) Int. Cl.
*F27D 3/02* (2006.01)

(52) U.S. Cl.
CPC ..... *F27D 3/028* (2013.01)

(58) Field of Classification Search
CPC ..... D21F 3/10; D21F 5/042; A47L 9/0477; A47L 9/28; B65H 2406/33;
(Continued)

(56) References Cited

U.S. PATENT DOCUMENTS 3,802,495 A * 4/1974 Hordis ..... B65G 39/02 165/89
3,860,387 A 1/1975 Bricmont
(Continued)

FOREIGN PATENT DOCUMENTS

CN 203559075 4/2014
CN 203904393 10/2014
(Continued)

*Primary Examiner* — Gregory A Wilson
(74) *Attorney, Agent, or Firm* — Abelman, Frayne & Schwab

(57) ABSTRACT

The invention relates to an uncooled furnace roll (1) for transporting continuously cast material from a continuous casting facility, and to a method for the production of such a furnace roll. The furnace roll (1) comprises a cylindrical roll body (2), conical end pieces (6) being attached to the end faces (8) of the roll body. Inside the furnace roll (1) a hollow space (4) is provided in the region of the roll body (2) and/or in the region of at least one conical end piece, said hollow space being sealed off from the atmosphere (A) and being placed under vacuum.

8 Claims, 3 Drawing Sheets

(58) Field of Classification Search
CPC .. B65H 2406/332; F26B 13/18; F26B 13/183; G03G 15/2053
See application file for complete search history.

(56) References Cited

U.S. PATENT DOCUMENTS

| | | | | | |
|---|---|---|---|---|---|
| 4,991,276 | A | | 2/1991 | Bricmont | |
| 5,031,338 | A | * | 7/1991 | Wedel | D21F 3/10 34/115 |
| 5,152,078 | A | * | 10/1992 | Wedel | D21F 5/04 34/115 |
| 5,205,398 | A | * | 4/1993 | Hart | B65G 39/07 193/37 |
| 5,230,618 | A | | 7/1993 | Bricmont | |
| 5,362,230 | A | * | 11/1994 | Facco | F27D 3/026 432/128 |
| 5,441,407 | A | | 8/1995 | Stamm | |
| 5,448,040 | A | | 9/1995 | Deplano | |
| 5,635,034 | A | * | 6/1997 | Viitanen | D21F 3/10 162/363 |
| 5,833,455 | A | | 11/1998 | Carr | |
| 6,435,867 | B1 | | 8/2002 | Carr | |
| 6,571,080 | B2 | * | 5/2003 | Lee | G03G 15/2053 219/469 |
| 6,638,472 | B2 | | 10/2003 | Lemke | |
| 8,622,188 | B2 | | 1/2014 | Yamaoka | |

FOREIGN PATENT DOCUMENTS

| | | |
|---|---|---|
| DE | 2205149 | 8/1973 |
| DE | 3807240 | 6/1989 |
| DE | 10223639 | 12/2003 |
| DE | 102004032143 | 1/2006 |
| EP | 444312 | 9/1991 |
| EP | 1134531 | 9/2001 |
| JP | 04285132 | 10/1992 |
| JP | 05105938 | 4/1993 |
| JP | 05222442 | 8/1993 |
| JP | 08035517 | 2/1996 |
| JP | 09194929 | 7/1997 |
| JP | 09194930 | 7/1997 |
| JP | 10311685 | 11/1998 |
| JP | 2011208218 | 10/2011 |
| JP | 2012207245 | 10/2012 |
| WO | 8804371 | 6/1988 |

* cited by examiner

UNCOOLED FURNACE ROLL AND METHOD FOR PRODUCING AN UNCOOLED FURNACE ROLL

RELATED APPLICATIONS:

This application is a National phase application of International Application PCT/EP2015/074928 filed Oct. 28, 2015 and claiming priority of German application DE 10 2014 224 445.5 filed Nov. 28, 2014, both applications are incorporated herein by reference thereto.

BACKGROUND OF THE INVENTION

1. Field of the Invention

The invention relates to an uncooled furnace roll for transporting continuously cast material from a continuous casting machine, according to the preamble of claim 1, and a method for producing such a roll, according to the preamble of claim 5.

2. Description of the Prior Art

In roller hearth furnaces in continuous casting facilities, continuous casting material is preheated to a rolling temperature. The rolled stock, e.g. in the form of thin slabs or the like, is transported through the continuous casting furnace by means of driven furnace rolls having various configurations. The furnace rolls are disposed at a specific furnace height at predetermined distances from each other. The dimensions of the furnace rolls are distinguished, relatively speaking, in that their diameters are small in comparison to their length in the axial direction.

The furnace rolls of a roll-type hearth furnace may be provided with water cooling means, as disclosed in, e.g., DE 10047046 A1. Alternatively, the furnace rolls may be in the form of so-called "dry rolls", which do not employ cooling means. The heat transport from the interior space of the tunnel furnace via a dry roll occurs via heat radiation, heat conduction in the steel, and heat condition via the furnace exhaust gases (convection). In contrast to the situation with water-cooled furnace rolls, uncooled furnace rolls do not have active cooling means for their components, and as a result appreciably less energy is withdrawn from the tunnel furnace.

SUMMARY OF THE INVENTION

Customary uncooled furnace rolls are comprised of a hollow cylindrical roll body which has a conical element bearing a journal, welded to each of its end faces. At least one bore in the wall of the roll body is provided which ensures sufficient air circulation between the hollow space of the roll body and the surroundings, given that the volume of air inside the roll body can vary depending on temperature fluctuations.

With a dry, uncooled furnace roll, the two conical regions of the roll are disposed in the neighborhood of the wall of the tunnel furnace. With such a furnace roll, in general an effort is made to minimize heat transfer from the furnace roll out of the tunnel furnace. In order to reduce the influence of heat radiation and convection from the interior space of the tunnel furnace to the surroundings, it is known under the prior art to provide insulation material in the hollow space of a furnace roll.

In each of FIGS. 6 and 7, a longitudinal cross-section of the end face of a customary uncooled furnace roll is shown. A plug comprised of thermally insulating fireproof material 100 (FIG. 6), or a device 102 having a plurality of heat protecting plates which together form a grid of plates (FIG. 7), can be inserted in the cone. The disadvantage of this is that it entails fabrication work, to emplace and mount the insulating means in the cone and/or hollow space of the furnace rolls, which is time-consuming and costly. A further disadvantage is that the service life of the fireproof material is less than that of the furnace roll. The long term rolling movements of the furnace roll cause the fireproof material to break down after its service life ends, whereby its good thermal insulation characteristics are lost.

The object of the present invention is to improve the thermal insulation of an uncooled furnace roll with simple and economical means, and at the same time to increase the service life of the roll.

This object is achieved by a furnace roll with the features of claim 1, and a method with the features of claim 5. Advantageous embodiments of the invention are set forth in the dependent claims.

An uncooled furnace roll according to the present invention serves for transporting continuously cast material in a continuous casting facility, and is comprised of a cylindrical roll body and conical end pieces, which end pieces are attached to the respective end faces of the roll body. Each end piece may have a respective journal at its outer side, for being received in a bearing or the like. Inside the furnace roll, in the region of the roll body, and/or in the region of at least one conical end piece, a hollow space is provided which is sealed with respect to the surroundings and is placed under vacuum, such that vacuum thermal insulation is present for the roll body and/or for the conical end piece.

In a method for producing an uncooled furnace roll, according to the present invention, first a cylindrical roll body and at least one conical end piece are produced. Then the conical end piece is attached to an end face of the roll body, so as to form a hollow space inside the furnace roll in the region of the roll body and/or of a conical end piece, which hollow space is sealed with respect to the surroundings; and said hollow space is placed under vacuum.

The invention is based on the essential recognition that the vacuum established in the hollow space of the furnace roll in the region of the roll body and/or of the conical end piece provides a substantial improvement in the thermal insulation for the furnace roll. The thermal insulation for the furnace roll is based solely on the vacuum prevailing in the hollow space, wherewith no additional materials, such as, e.g. fireproof wool or thermally conducting plates, are needed in the hollow space. Given that the volume of air in the hollow space of the furnace roll is essentially zero, which if present would tend to expand in the event of temperature fluctuations, in contrast with customary furnace rolls it is unnecessary with inventive furnace rolls to have an opening in the roll body for circulation of air with the surroundings. The circumstance that the hollow space is tightly closed with respect to the surroundings, whereby air circulation between the hollow space of the furnace roll and the atmosphere does not occur, leads to the further advantage that heat transfer via convection is substantially reduced.

If a furnace roll according to the present invention is fabricated in a vacuum chamber, in the course of which fabrication at least one conical end piece, for an end face of the roll body, or preferably two conical end pieces, one for each end face of the roll body, is/are attached to said end face(s), the above-described vacuum heat insulation is automatically brought about by such a fabrication process. Advantageously, the conical end pieces may be attached to the end faces of the roll body by means of electron beam welding (EB welding). This can obviate the need for additional fabrication steps to produce a vacuum in the hollow space. EB welding also provides other advantages: the average weld seam width is small, the zones of thermal influence are narrow and limited, and are free of oxidation discoloration, the weld depth is high, and the speed of welding is high—provided that the intensity of the electron beam is high. As a result of the exact reproducibility of the EB welding, one can be assured of uniform quality of the attachment loci between the roll body and the conical end pieces welded to it. Moreover, it is possible to carry out a plurality of welds simultaneously.

According to an advantageous refinement of the invention, the roll body may be in the form of a cylindrical hollow body, so that the hollow space of the furnace roll extends at least along the entire longitudinal axis of the roll body. This ensures that the desired thermal insulation means will be effective at least in the area of the entire length of the roll body.

According to another advantageous refinement of the invention, a conical end piece may be in the form of a cap element. With this arrangement, a hollow space is formed inside the conical end piece when said end piece is attached to an end face of the roll body. In the context of the present invention, this hollow space is placed under vacuum in the conical end piece. Regardless of whether a hollow space is also provided in the roll body itself, the establishment of a vacuum inside the conical end piece provides effective vacuum thermal insulation for this component.

According to still another advantageous refinement of the invention, the roll body is in the form of a cylindrical hollow body, and at least one conical end piece is in the form of a cap element. Consequently, when the conical end piece is attached to an end face of the roll body, the hollow space of the furnace roll is present both in the roll body and in the conical end piece, extending continuously in these two elements, which space is sealed with respect to the surroundings and (as described) is under vacuum. Accordingly, the advantageous vacuum thermal insulation extends from the roll body into the conical end piece.

According to yet another advantageous refinement of the invention, a connecting valve may be disposed in a wall of the roll body or of a conical end piece, which valve is in fluid communication with the hollow space of the furnace roll. With the use of the connecting valve and a separate vacuum pump or the like, it is possible to place the hollow space completely [sic] under vacuum. After the hollow space has thus been placed completely under vacuum, the connecting valve can be appropriately closed such that the hollow space is sealed with respect to the surroundings and the vacuum in the hollow space is maintained. Advantageously, the connecting valve is in the form of a check valve which automatically closes after the vacuum is established in the hollow space, and said valve seals the hollow space with respect to the surroundings.

The provision of a connecting valve, and the described establishment of a vacuum in the hollow space with the use of said connecting valve, affords the advantage that one does not need to work in a vacuum chamber in order to produce a furnace roll according to the invention. The individual components of the furnace roll, namely the roll body and the two conical end pieces, may then be welded together under a normal atmosphere, following which the hollow space of the furnace roll may be placed under vacuum via the connecting valve.

It should be understood that the features described above and hereinbelow may be employed not only in the described combinations but also in other combinations, or individually, without departing from the scope of the invention.

BRIEF DESCRIPTION OF THE DRAWINGS:

The invention is illustrated schematically in the accompanying drawings, and will be described in more detail hereinbelow, with reference to preferred embodiments.

DETAILED DESCRIPTION OF THE PREFERRED EMBODIMENTS

Figure 1:
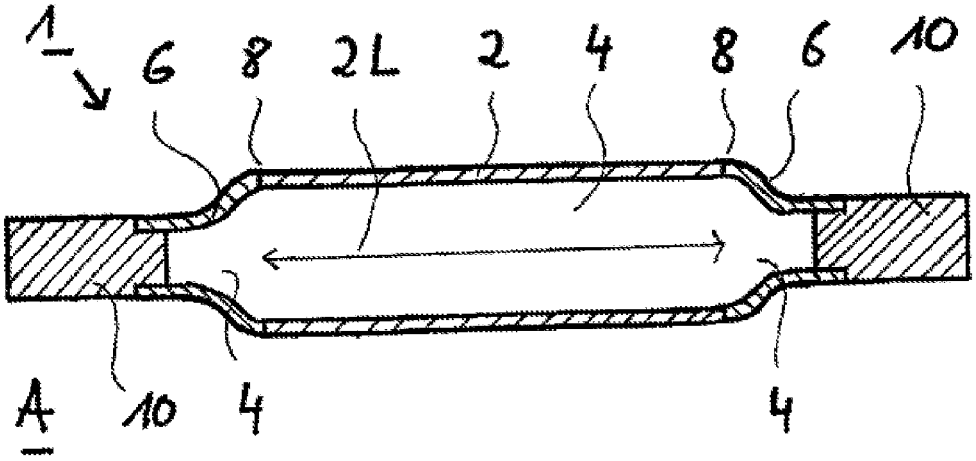
FIG. 1 is a simplified longitudinal cross-section of an inventive furnace roll according to a first embodiment.

FIG. 1 illustrates an inventive furnace roll 1 (not necessarily with correct dimensions and dimensional relationships), in a simplified longitudinal cross-section. The furnace roll 1 is comprised of a roll body 2 in the form of a cylindrical hollow body. The roll body 2 surrounds a hollow space 4. Conical end pieces 6 are attached to the end faces 8 of the roll body 2, thereby separating the hollow space 4 from the atmosphere A.

Given that the roll body 2 is in the form of a cylindrical hollow body, the hollow space 4 of the furnace roll 1 extends at least along the entire longitudinal axis 2L of the roll body 2. As illustrated in FIG. 1, the two conical end pieces 6 are in the form of cap elements. Accordingly, when the end pieces 6 are attached to the respective end faces 8 of the roll body 2, the hollow space 4 extends in the furnace roll 1 into the end pieces 6.

Figure 2:
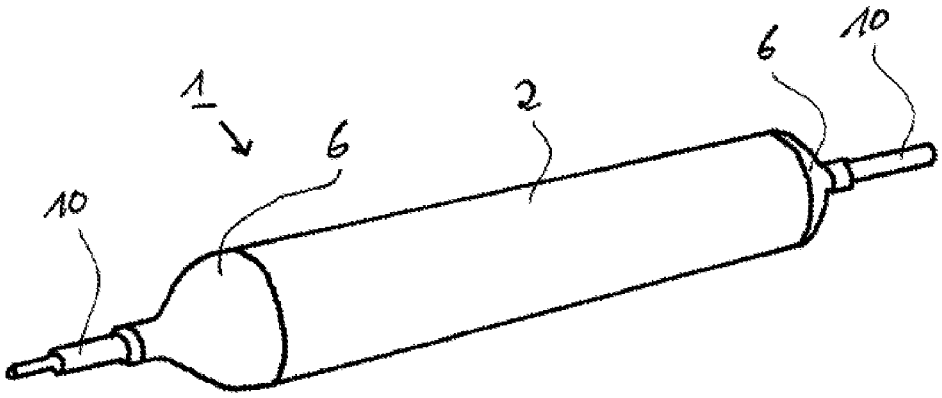
FIG. 2 is a perspective view of the furnace roll according to FIG. 1.

The furnace roll according to FIG. 1 is illustrated in FIG. 2 in a perspective view. Journals 10 are affixed to the outer parts of the conical end pieces 6, which journals are rotatably mounted in bearings or the like (not shown). This arrangement with the journals 10 enables the furnace roll 1 to be driven rotationally around its longitudinal axis.

In the embodiment according to FIG. 1, the hollow space of the furnace roll 1 is sealed with respect to the atmosphere A, and is placed under vacuum. Due to the fact that no air is present inside the hollow space 4, thermal insulation in the form of a vacuum is provided for the furnace roll 1 along its longitudinal axis, i.e. in the region of the roll body 2 and the two conical end pieces 6.

Figure 3:
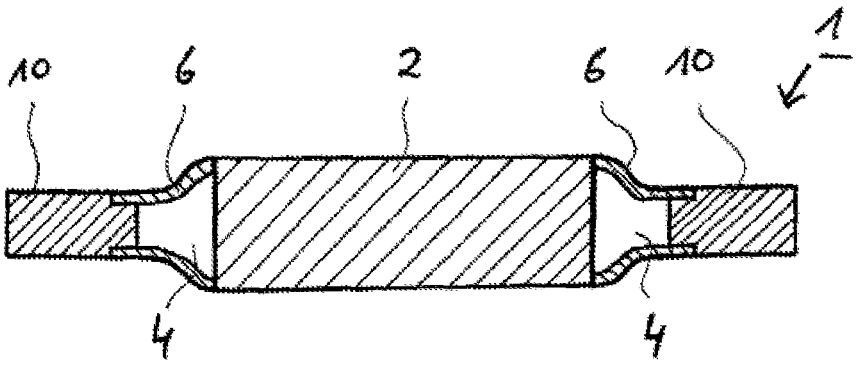
FIG. 3 is a simplified longitudinal cross-section of an inventive furnace roll according to a second embodiment.

FIG. 3 illustrates a simplified longitudinal cross-section of a furnace roll 1 (not necessarily with correct dimensions and dimensional relationships), according to a second embodiment of the invention. In contrast to the embodiment according to FIG. 1, the roll body 2 in the embodiment according to FIG. 3 is in the form of a solid cylinder, which has two conical end pieces 6 in the form of cap elements attached to its end faces 8. A hollow space 4 placed under vacuum is present in the embodiment according to FIG. 3 only in the conical end pieces 6, so that the vacuum insulation is effective at least for the conical end pieces 6. The roll body 2 in the embodiment according to FIG. 3 may comprise a cylindrical hollow body instead of a solid cylinder, but wherein the hollow space in the hollow body is not in communication with the hollow spaces 4 in the conical end pieces 6. With this arrangement, the wall of the roll body 2 may have an opening in it for air circulation with the atmosphere A, to adjust for volume changes in the air due to temperature fluctuations affecting the furnace roll 1 during operation of a tunnel furnace. In addition, thermal insulation material, e.g. fireproof material, may be provided in the hollow space of the roll body.

In the following a method of producing the furnace roll 1 according to the present invention, with generation of a vacuum in the hollow space 4 of the furnace roll 1, is described; this is with reference to FIGS. 4 and 5. In other words, the inventive method will be described, with reference to FIGS. 4 and 5.

Figure 4:
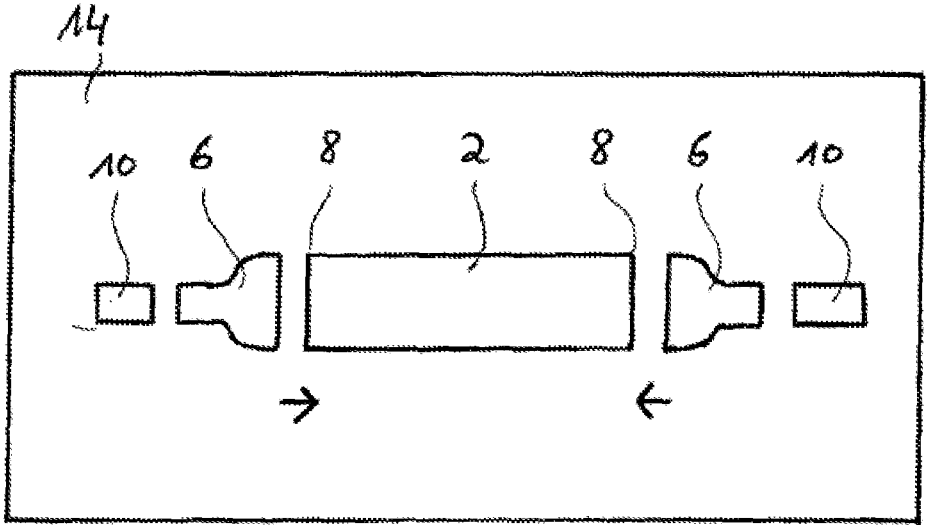
FIG. 4 is a greatly simplified schematic drawing of a vacuum chamber with which (in which) the inventive method of producing a furnace roll according to FIG. 1 can be carried out.

FIG. 4 illustrates generally a greatly simplified representation of a vacuum chamber 14 in which vacuum welding processes can be performed.

To fabricate an inventive furnace roll 1, its individual components, i.e. the roll body 2 and the two conical end pieces 6, can be brought into the vacuum chamber 14. The two conical end pieces 6 are then welded to the end faces 8 of the roll body 2. The arrows in FIG. 4 indicate the application of the two conical end pieces 6 against the end faces 8 of the roll body 2. The means of fastening the conical end pieces 6 to the end faces 8 of the roll body 2 may comprise electron beam welding (EB welding).

The fabrication of a furnace roll 1 by means of welding its components together in a vacuum chamber 14 may apply for the embodiment according to FIG. 3 as well as to the embodiment according to FIG. 1. In each instance, due to the fabrication process being performed in vacuum, it is automatically provided that, following the attachment of the two conical end pieces 6 to the end faces 8 of the roll body 2, the hollow space 4 thereby generated and sealed against the surroundings is also under vacuum, which vacuum persists after the completion of the welding work and after the furnace roll 1 is removed from the vacuum chamber 14. In this connection, it is no longer necessary to provide air flow (air removal) openings in the wall of the roll body 2 or of a conical end piece 6.

The journals 10 can be welded onto the respective conical end pieces 6 in the vacuum chamber 14.

Figure 5:
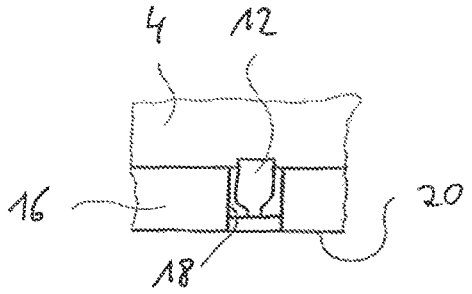
FIG. 5 Prior Art
FIG. 5 is a longitudinal cross-section of a wall of a furnace roll according to yet another embodiment.
Figure 6:
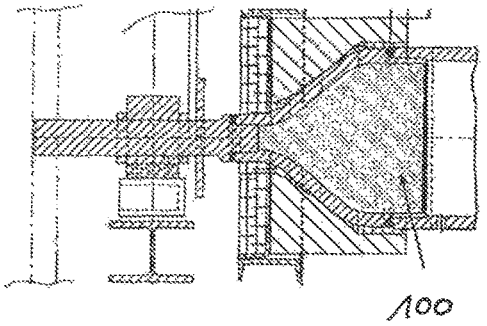
FIG. 6 Prior Art
FIG. 6 is a longitudinal cross-section of an end face a customary uncooled furnace roll.
Figure 7:
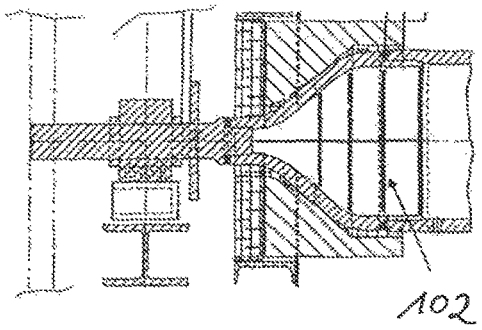
FIG. 7 is a longitudinal cross-section of an end face of another embodiment of a customary uncooled furnace roll.

FIG. 5 illustrates a connecting valve 12 provided in a wall 16 of the roll body 2 or of a conical end piece 6. The connecting valve 12 is in fluid communication with the hollow space 4 of the furnace roll 1. A vacuum pump or the like can be connected to the connecting valve 12 through a connecting line (not shown), to produce a complete vacuum in the hollow space 4 of the furnace roll 1.

The connecting valve 12 is preferably in the form of a check valve. In any event, the connecting valve 12 is configured such that, after a vacuum is produced in the hollow space 4, the hollow space will be sealed against the surroundings by the connecting valve 12, such that the vacuum in the hollow space will be maintained.

A somewhat recessed opening 18 is provided for the connecting valve 12 in an outer surface 20 of the roll body 2. Thus, the opening 18 does not project radially beyond the outer circumferential surface 20, as a result of which rolled stock being transported via the roll body 2 does not come into contact with the opening 18.

Alternatively to use of a vacuum chamber 14 (FIG. 4), a connecting valve 12 as described above in connection with FIG. 5 can be employed to fabricate a furnace roll 1 in a normal atmosphere. Then, after the two conical end pieces 6 have been welded to the end faces 8 of the roll body 2, the connecting valve 12 may be utilized for producing a vacuum in the hollow space 4 formed in the furnace roll 1, wherewith, after a complete vacuum has been established in the hollow space 4, the connecting valve 12 may be utilized to seal it against the atmosphere.

LIST OF REFERENCE NUMERALS

1 Furnace roll.
2 Roll body.
2L Longitudinal axis of the roll body.
4 Hollow space.
6 End piece.
8 End face of the roll body.
10 Journal.
12 Connecting valve.
14 Vacuum chamber.
16 Wall of the roll body 2 or of a conical end piece 6.
18 Opening for the connecting valve.
20 Outer circumferential surface.
A Atmosphere.

The invention claimed is:

1. An uncooled furnace roll (1) for transporting continuously cast material from (or in) a continuous casting facility comprised of a cylindrical roll body (2), and conical end pieces (6) which are attached to the respective end faces (8) of the roll body (2), characterized in that inside the furnace roll (1) a hollow space (4) is provided in the region of the roll body (2) and/or in the region of at least one conical end piece (6), said hollow space being sealed off from the atmosphere (A) and being under vacuum, so that vacuum means of thermal insulation are provided, at least for the roll body (2) and/or the conical end piece (6), and in that a connecting valve (12) is disposed in a wall (16) of the roll body (2) or of a conical end piece (6), which valve is in fluid communication with the hollow space (4) of the furnace roll, wherein the hollow space (4) of the furnace roll can be placed under vacuum via the connecting valve (12); wherein the connecting valve (12) is in the form of a check valve which shuts off the hollow space (4) with respect to the atmosphere (A) when the hollow space (4) is placed completely under vacuum.

2. The furnace roll (1) according to claim 1, characterized in that the cylindrical roll body (2) is entirely hollow, so that the hollow space (4) of the furnace roll extends at least along the entire longitudinal axis (2L) of the roll body (2), preferably such that the cylindrical roll body (2) is in the form of a cylindrical sleeve with a corresponding hollow space (4).

3. The furnace roll (1) according to claim 2, characterized in that at least one conical end piece (6) is in the form of a cap element, so that the hollow space (4) of the roll body (2), placed under vacuum, extends into the conical end piece (6) when said end piece (6) is attached to the end face (8) of the roll body (2).

4. A method for producing an uncooled furnace roll (1), characterized by the following steps:

preparing a cylindrical roll body (2);

preparing at least one conical end piece (6); and attaching a conical end piece (6) to an end face (8) of the roll body (2), such that thereby a hollow space (4) which is formed inside the furnace roll (1) in the region of the roll body (2) and/or in the region of the conical end piece (6) is closed off so as to be sealed against the atmosphere (A), wherewith the hollow space (4) is placed under vacuum;

attaching the conical end piece (6) to an end face (8) of the roll body (2) in a vacuum chamber (14) by means of electron beam welding (EB welding).

5. The method according to claim 4, characterized in that a conical end piece (6) is attached to one of the two end faces (8) of the cylindrical roll body (2) before a second conical end piece (6) is attached to the still open opposite end face (8) of the roll body (2), in a vacuum chamber (14).

6. The method according to claim 4, characterized in that a respective conical end piece (6) is attached to the roll body (2) at both of its end faces (8), in the vacuum chamber (14).

7. A method for producing an uncooled furnace roll (1), characterized by the following steps:

preparing a cylindrical roll body (2);

preparing at least one conical end piece (6); and attaching the conical end piece (6) to an end face (8) of the roll body (2), such that thereby a hollow space (4) which is formed inside the furnace roll (1) in the region of the roll body (2) and/or in the region of the conical end piece (6) is closed off so as to be sealed against the atmosphere (A), wherewith the hollow space (4) is placed under vacuum;

providing a connecting valve (12) which is in fluid communication with the hollow space (4) of the furnace roll and is disposed in a wall (16) of the roll body (2) or of the conical end piece (6), wherein after the conical end piece (6) is attached to the roll body (2), which serves to close off the hollow space (4), a vacuum is applied to the connecting valve (12), whereby the hollow space (4) is placed completely under vacuum; and wherein the connecting valve (12) is in the form of a check valve, which closes off the hollow space (4) with respect to the atmosphere (A) when the hollow space (4) has been placed completely under vacuum.

8. The method according to claim 7, characterized in that the connecting valve (12), with its opening (18), is recessed (countersunk) in an external surface (20) of the roll body (2) or of the end piece (6).

* * * * *